US012486057B2

(12) United States Patent
Casale et al.

(10) Patent No.: US 12,486,057 B2
(45) Date of Patent: Dec. 2, 2025

(54) SELF-PROPELLED WRAPPING MACHINE AND WRAPPING METHOD

(71) Applicant: ROBOPAC S.P.A., Acquaviva-Gualdicciolo (SM)

(72) Inventors: Cristiano Casale, Acquaviva-Gualdicciolo (SM); Massimo Grassi, Acquaviva-Gualdicciolo (SM); Fabio Toma, Acquaviva-Gualdicciolo (SM)

(73) Assignee: ROBOPAC S.P.A., Acquaviva-Gualdicciolo (SM)

( * ) Notice: Subject to any disclaimer, the term of this patent is extended or adjusted under 35 U.S.C. 154(b) by 0 days.

(21) Appl. No.: 18/862,345

(22) PCT Filed: Apr. 27, 2023

(86) PCT No.: PCT/IB2023/054347
§ 371 (c)(1),
(2) Date: Nov. 1, 2024

(87) PCT Pub. No.: WO2023/214257
PCT Pub. Date: Nov. 9, 2023

(65) Prior Publication Data

US 2025/0289601 A1 Sep. 18, 2025

(30) Foreign Application Priority Data

May 2, 2022 (IT) ..... 102022000008825

(51) Int. Cl.
*B65B 41/14* (2006.01)
*B65B 11/02* (2006.01)

(52) U.S. Cl.
CPC ..... *B65B 11/025* (2013.01); *B65B 41/14* (2013.01); *B65B 2210/20* (2013.01)

(58) Field of Classification Search
USPC ..... 53/461
See application file for complete search history.

(56) References Cited

FOREIGN PATENT DOCUMENTS

WO 2020/165721 8/2020
WO WO-2020165721 A1 * 8/2020 ..... B65B 11/025
(Continued)

OTHER PUBLICATIONS

International Search Report (ISR) issued Aug. 25, 2023 in International (PCT) Application No. PCT/IB2023/054347.

*Primary Examiner* — Chinyere J Rushing-Tucker
(74) *Attorney, Agent, or Firm* — WENDEROTH, LIND & PONACK, L.L.P.

(57) ABSTRACT

A self-propelled wrapping machine has an anchoring element including a base adapted to abut a supporting plane and connected to an upper plate, and a locking element between the upper plate and the base. The locking element and base are movable relative to each other between closed and open configurations. The machine also has a first gripping unit movable and configured to position and release the anchoring element, associated with an initial flap of film blocked between the locking element and the base in the closed configuration, on the supporting plane adjacent to a load in an initial step of wrapping, and to grasp and lift the anchoring element and move the locking element and the base to the open configuration to release the initial flap of film after at least one turn travelled by the self-propelled wrapping machine around the load while wrapping it with the film.

24 Claims, 8 Drawing Sheets

(56) References Cited

FOREIGN PATENT DOCUMENTS

| | | |
|---|---|---|
| WO | 2020/174388 | 9/2020 |
| WO | 2022/029642 | 2/2022 |

* cited by examiner

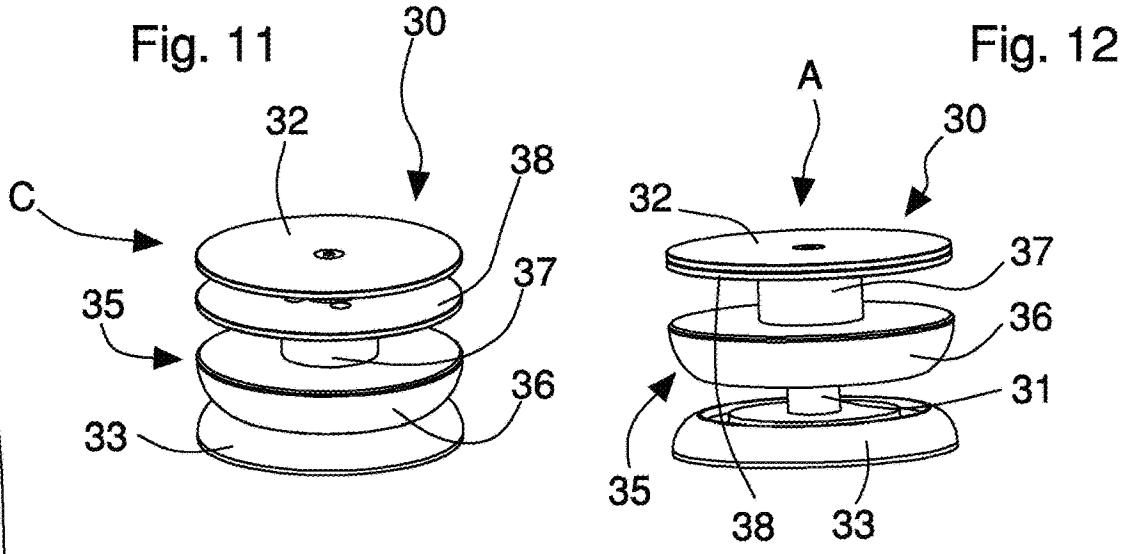
Fig. 12
Fig. 11
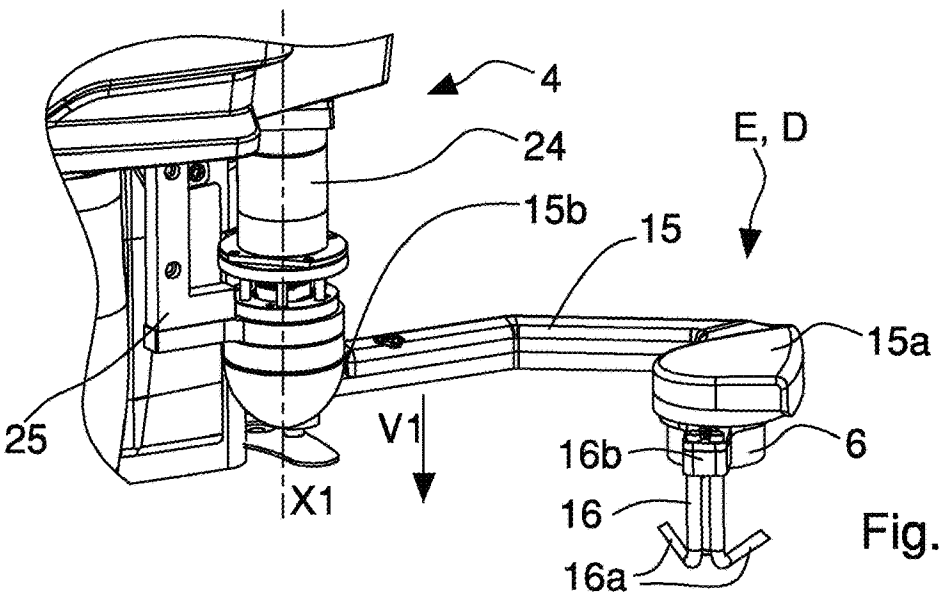
Fig. 3
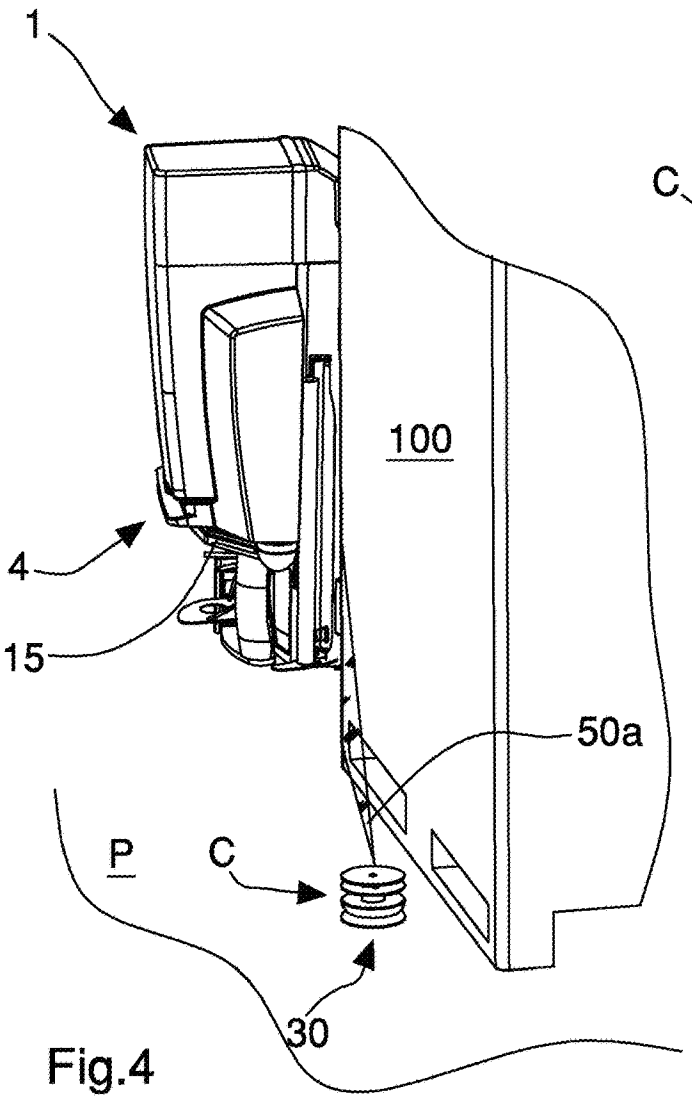
Fig.4

Fig. 10
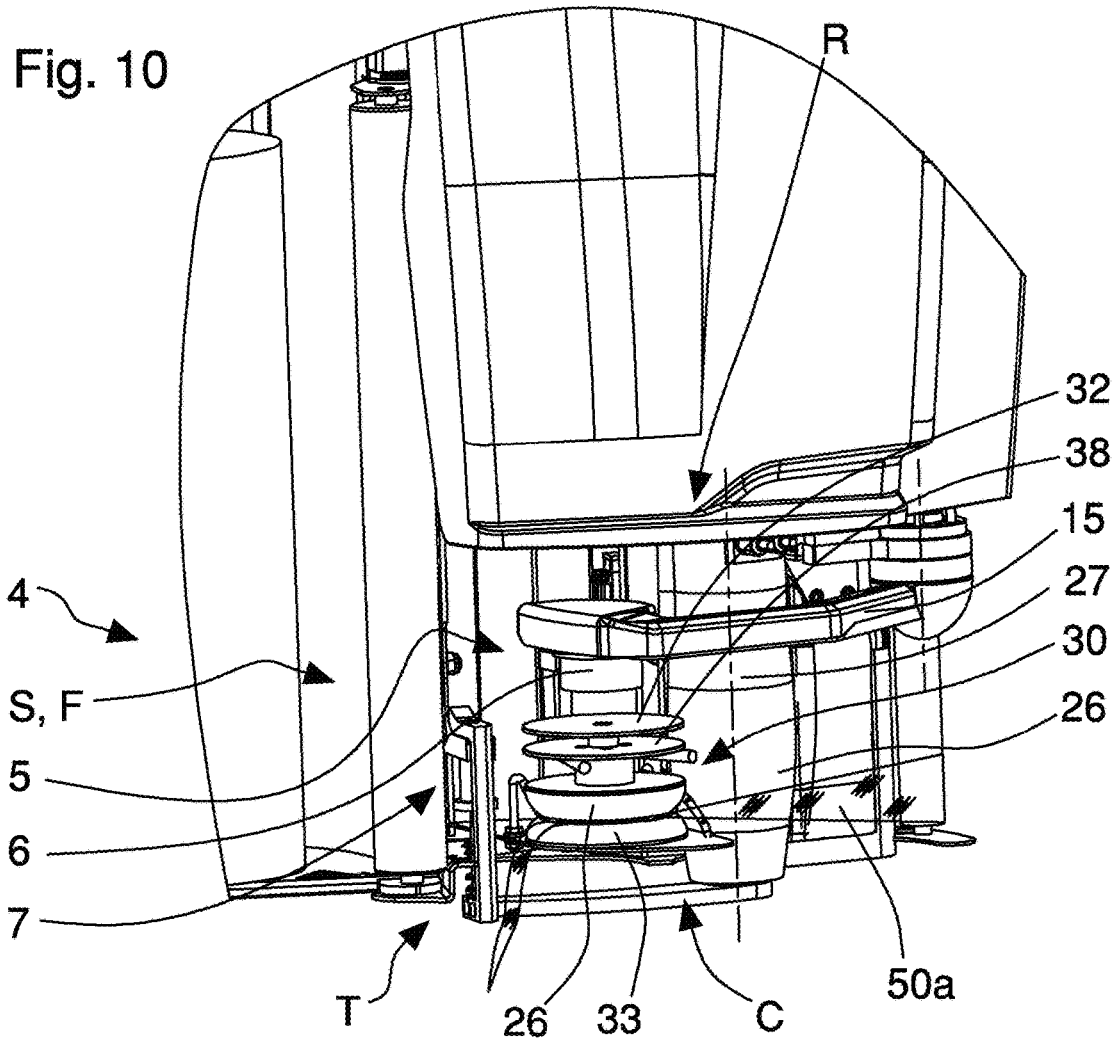
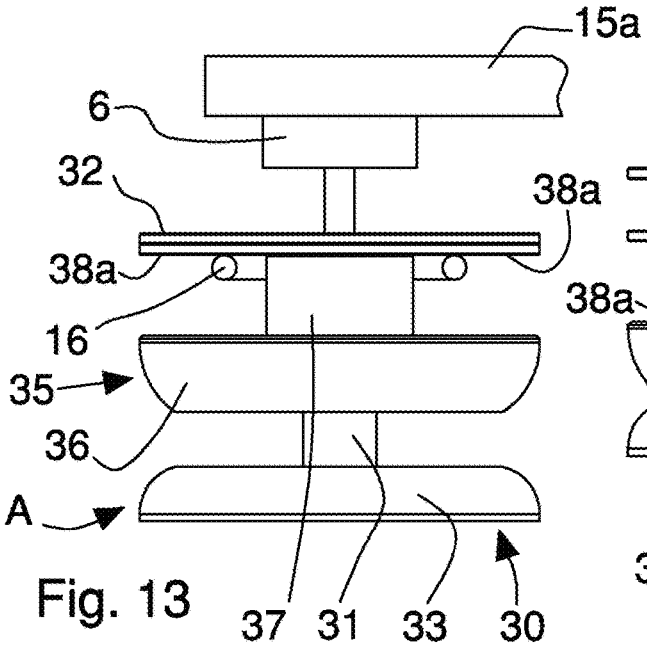
Fig. 13
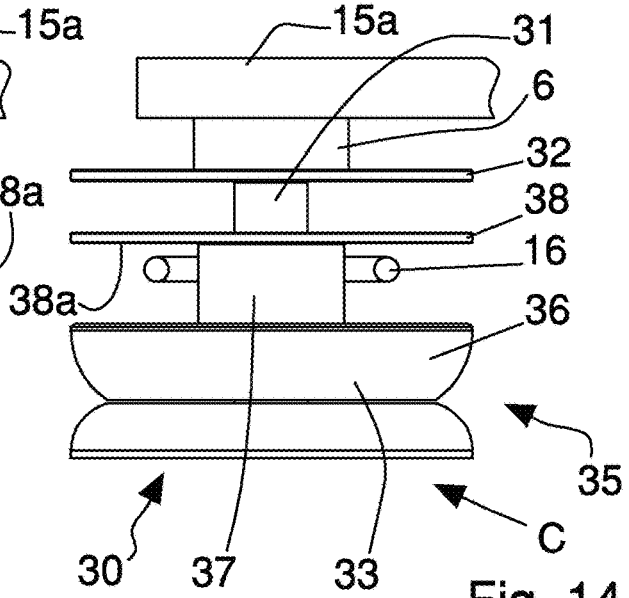
Fig. 14

SELF-PROPELLED WRAPPING MACHINE AND WRAPPING METHOD

The invention relates to a mobile or self-propelled wrapping machine arranged to wrap a film made of a plastic material around a load consisting of a product or a group of products arranged on a skid or pallet. The invention also relates to a wrapping method implemented by the aforementioned self-propelled wrapping machine.

Self-propelled wrapping machines, also referred to as self-propelled wrapping robots, are machines generally used to wrap loads having variable shapes and sizes and in productions in limited amounts, typically in environments or housings where fixed or static wrapping machines cannot be used because of the overall dimensions and/or available spaces. The loads are generally formed by skids or pallets on which a group of more or less regularly overlapped products and/or objects, even having different sizes and formats, is arranged. In other cases, the wrapping, normally for protective purposes, directly concerns the product, which is generally large-sized.

The self-propelled wrapping machines include a cart or carriage that supports a vertical upright along which a film unwinding or supplying unit, which houses a reel of plastic film and is generally provided with a plurality of rollers for unwinding and pre-stretching the film, is movable, with alternating rectilinear motion. More precisely, the unwinding unit is provided with a pair of pre-stretching rollers suitable for unwinding the film from the reel and pre-stretching or extending the film by a predefined percentage, and one or more return rollers to divert the film towards the load.

The carriage is usually provided with motor-powered rear traction wheels and with a front driving device which comprises one or more steering wheels, operated by a steering. The steering may be operated via a guide bar by an operator to manually drive the machine in a manoeuvring configuration, or from a feeler element capable of following the profile or external shape of the load in an operational working configuration, in which the self-propelled machine turns autonomously and automatically around the load to wrap it with the film.

The combination of the alternating linear movement of the unwinding unit along the vertical upright and the rotation of the self-propelled machine around the load allows the film to be wrapped around the load so as to form a series of intertwined strips or bands. The plastic film is wrapped to completely cover the load on all its sides.

The feeler element comprises an arm extending externally and laterally with respect to the carriage and is provided at its end with an idle wheel capable of following the external outline of the load to be wrapped. The feeler element exerts a predefined elastic compression or thrust force on the load, so as to maintain a contact with the load and to allow the machine to move reliably around the load according to a path determined by the outline of the load itself.

Self-propelled wrapping machines are also known that comprise sensors instead of the feeler element, such as ultrasonic sensors, capable of detecting the external surfaces and edges of the load and processing related signals which allow a control unit of the wrapping machine to calculate a wrapping path around the load which avoids collisions. More precisely, based on the external surfaces and edges of the load detected by the sensors, the control unit controls the steering wheels and/or the driving wheels of the carriage so as to steer and drive the carriage around the load.

In both types of known self-propelled wrapping machines described above, although the wrapping step takes place in a substantially automatic way, i.e., without manual intervention by an operator, the operator is needed both in an initial step of the wrapping process in order to fix an initial flap or end of the film to the load or to the underlying pallet and in a final step in order to cut the film and separate it from the reel.

Therefore, the known self-propelled wrapping machines have the disadvantage of not allowing to carry out wrapping processes in a fully automated way, that is, without any manual intervention by operators.

WO 2022/029642 discloses a self-propelled wrapping machine movable on a supporting plane for wrapping a load with a film comprising a self-propelled carriage and an upright fixed to the carriage and slidably supporting an unwinding unit provided with a reel of film; an anchoring element provided with locking means selectively operable in the closed or open position respectively for locking or releasing an initial flap of film unwound from the reel. The wrapping machine further comprises a first gripping unit adapted to position and release the anchoring element with the initial flap of film locked by the locking means on the supporting plane adjacent to the load in an initial step of a wrapping cycle, and adapted to grip and lift the anchoring element and operate the locking means in the open position to release the initial flap of film after at least one turn travelled by the wrapping machine around the load, wrapping it with the film.

An object of the invention is to improve the known self-propelled wrapping machines arranged to wrap a load with an extensible plastic film.

Another object is to provide a self-propelled wrapping machine which allows to wrap a load with a film completely automatically, without requiring any manual intervention by an operator.

A further object is to provide a self-propelled wrapping machine which allows to make firm and stable wrappings.

In a first aspect of the invention a self-propelled wrapping machine according to claim 1 is provided.

In a second aspect of the invention a wrapping method according to claim 16 is provided. The invention can be better understood and implemented with reference to the attached drawings which illustrate an exemplary and non-limiting embodiment thereof, in which:

FIG. 3 is an enlarged partial perspective view illustrating a first gripping unit of the self-propelled wrapping machine of FIG. 1 with its first arm in an extended and raised position;

FIG. 4 is another enlarged partial perspective view of the self-propelled wrapping machine of FIG. 1 in a first wrapping turn of the load;

FIG. 10 is an enlarged partial perspective view of the machine of FIG. 1 in a step of gripping the initial flap of film by the anchoring element arranged in the housing;

FIGS. 11 and 12 are enlarged perspective views of the anchoring element with a locking element and a base respectively abutting, in a closed configuration, and spaced apart, in an open configuration;

FIG. 13 is an enlarged front view of the anchoring element supported by second gripping means of the first gripping unit, partially illustrated, with the locking element and the base arranged spaced apart in the open configuration;

FIG. 14 is an enlarged front view of the anchoring element supported by the first gripping means of the first gripping unit, partially illustrated, with the locking element and the base arranged abutting in the closed configuration.

Figure 1:
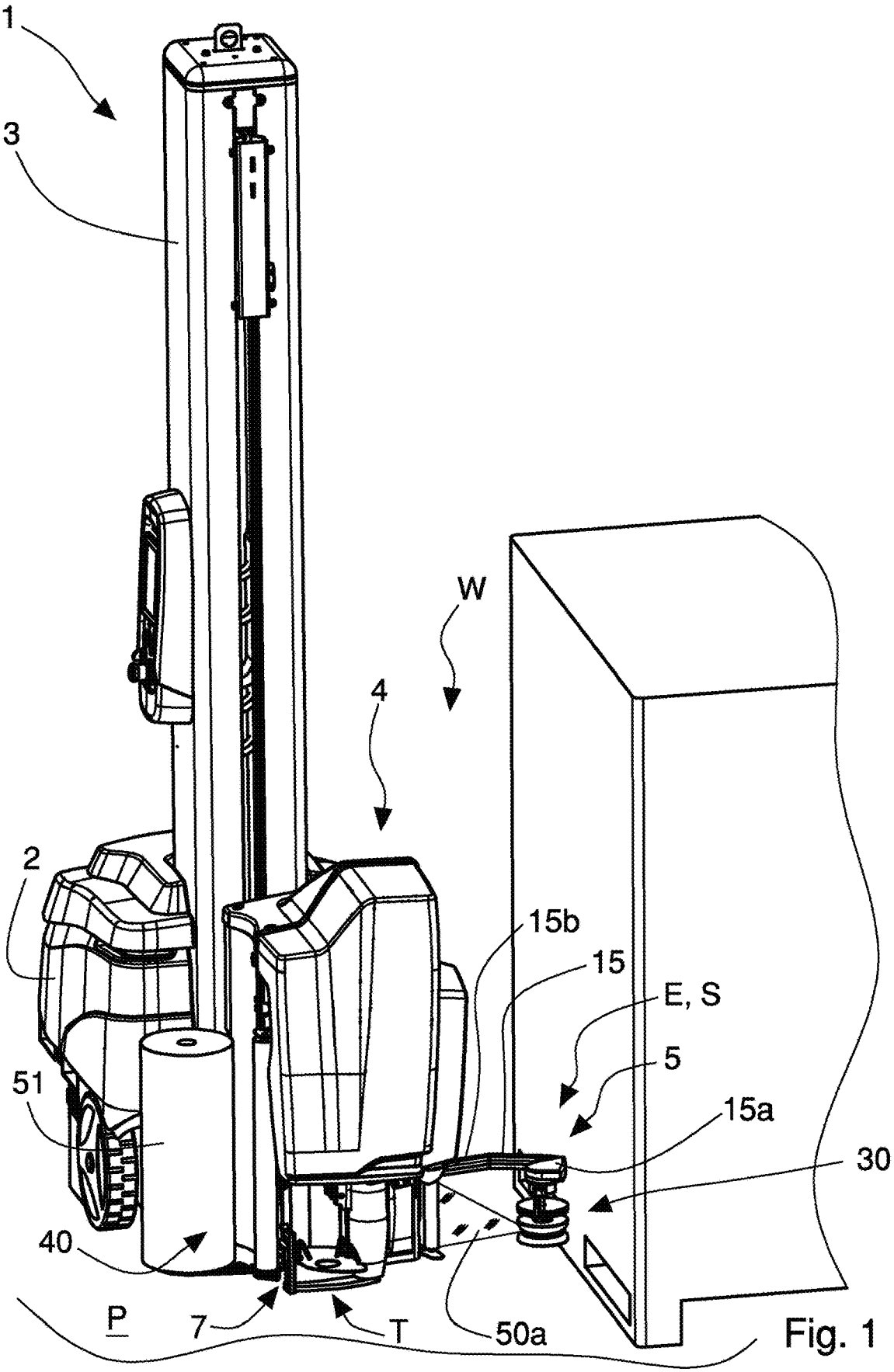
FIG. 1 is a perspective view of the self-propelled wrapping machine of the invention associated with a load to be wrapped, partially depicted, in an initial step of a wrapping cycle.

Referring to FIGS. 1 to 10, a self-propelled wrapping machine 1 according to the invention is illustrated that is movable on a supporting plane P (for example the ground or floor of a production site) around a load 100 to wrap it with a film 50 made of a plastic material, in particular of the cold-extensible type, during a wrapping cycle. The load 100 consists, for example, of one or more products arranged on a pallet or skid.

The self-propelled wrapping machine 1 comprises a self-propelled or mobile carriage 2 and an upright 3 fixed to the carriage and slidably supporting an unwinding unit 4. The unwinding unit 4 is provided with a reel 51 of a film 50 and roller means 40, of known type and not described and illustrated in detail, for unwinding and pre-stretching the film 50. The upright 3 is substantially vertical.

The self-propelled wrapping machine 1 further comprises a first gripping unit 5 and a second gripping unit 7 both fixed and supported by the carriage 2 and a movable anchoring element 30 to which an initial flap or end 50*a* of film unwound from the reel 51 can be removably fixed. The initial flap 50*a* of film is generated in a previous wrapping cycle performed by the self-propelled wrapping machine 1 or is manually unwound from a new reel 51 by an operator.

The carriage 2 comprises a rear support frame 20 to which the first gripping unit 5 and the second gripping unit 7 are fixed and which comprises a housing 22 suitable to receive and support the anchoring element 30, when the self-propelled wrapping machine 1 is not working or during the wrapping step of the load 100, as better explained in the description below.

With particular reference to FIGS. 11 to 14, the anchoring element 30 includes a base 33, adapted to abut the supporting plane P and connected by means of a central pin 31 to an upper gripping plate 32, and a locking element 35 interposed between the upper plate 32 and the base 33, engaged to, and movable along, the central pin 31. The locking element 35 and the base 33 with the upper plate 32 are movable with respect to each other between a closed configuration C, in which they abut, and an opening position A, in which they are spaced apart.

The first gripping unit 5, supported by the carriage 2, is movable and configured to position and release the anchoring element 30, to which the initial flap 50*a* of film is associated, blocked between the locking element 35 and the base 33 arranged abutting to each other in the closed configuration C, on the supporting plane P adjacent to the load 100, in an initial step of the wrapping cycle, and to grip and lift the anchoring element 30 and space the locking element 35 and the base 33 apart from each other in the open configuration A so as to release the initial flap 50*a* of film, after at least one turn travelled by the self-propelled wrapping machine 1 around the load 100, wrapping it with the film 50 dispensed by the unwinding unit 4.

The first gripping unit 5 comprises first gripping means 6 and second gripping means 16 selectively and alternatively activable to engage and grip the upper plate 32 or the locking element 35, respectively.

The first gripping means 6, in particular when engaged with the upper plate 32 (and with the second gripping means 16 disengaged from the locking element 35), are further configured to arrange and/or maintain the locking element 35 and the base 33 in the closed configuration C.

The second gripping means 16, in particular when engaged with the locking element 35 (and with the first gripping means 6 disengaged from the upper plate 32), are further configured to arrange and/or maintain the locking element 35 and the base 33 in the open configuration A.

The locking element 35 is brought and/or maintained abutting the base 33 by the gravity force acting thereon when the anchoring element 30 is released and disengaged from the first or second gripping means 6, 16 or when it is gripped and lifted by the first gripping means 6 acting on the upper plate 32, as better explained below.

In particular, the locking element 35 includes a locking plate 36 adapted to abut the base 33 and connected by means of a central element 37 to an intermediate plate 38. The locking plate 36, the central element 37 and the intermediate plate 38 comprise respective aligned longitudinal through openings, adapted to receive and slidably engage the central pin 31. The central pin has for example a cylindrical shape and the through openings of the locking plate 36, the central element 37 and the intermediate plate 38 are also cylindrical. The central element 37 has also a cylindrical shape.

In the embodiment shown in the figures, the upper plate 32, intermediate plate 38, locking 36 plate and the base 33 have a disc shape, i.e., a circular plan shape, and are coaxial with respect to a common central axis Y.

The locking plate 36 has a weight comprised between 1.5 and 2.5 kg, while the anchoring element 30 has an overall weight, for example of at least 3.5 kg, such as to allow the anchoring element to retain, without moving, the initial flap 50*a* of film in the established position on the supporting plane P without moving during the first wrapping turn with the film 50 of the self-propelled wrapping machine 1 around the load 100

The first gripping means 6 of the first gripping unit 5 comprise electromagnet means selectively activable or deactivable for gripping or releasing the upper plate 23 of the anchoring element 30, respectively. For this purpose at least the upper plate 23 is made of ferromagnetic material.

The second gripping means 16 comprise a fork element, in particular arranged aligned with and underneath the first gripping means 6, configured to engage the locking element 35 (FIG. 3). More precisely, the fork element 16 is insertable between the intermediate plate 38 and the locking plate 36 so as to engage the central element 37. The fork element 16 abuts a lower face 38*a* of the intermediate plate 38 for lifting and supporting the anchoring element 30.

Figure 2:
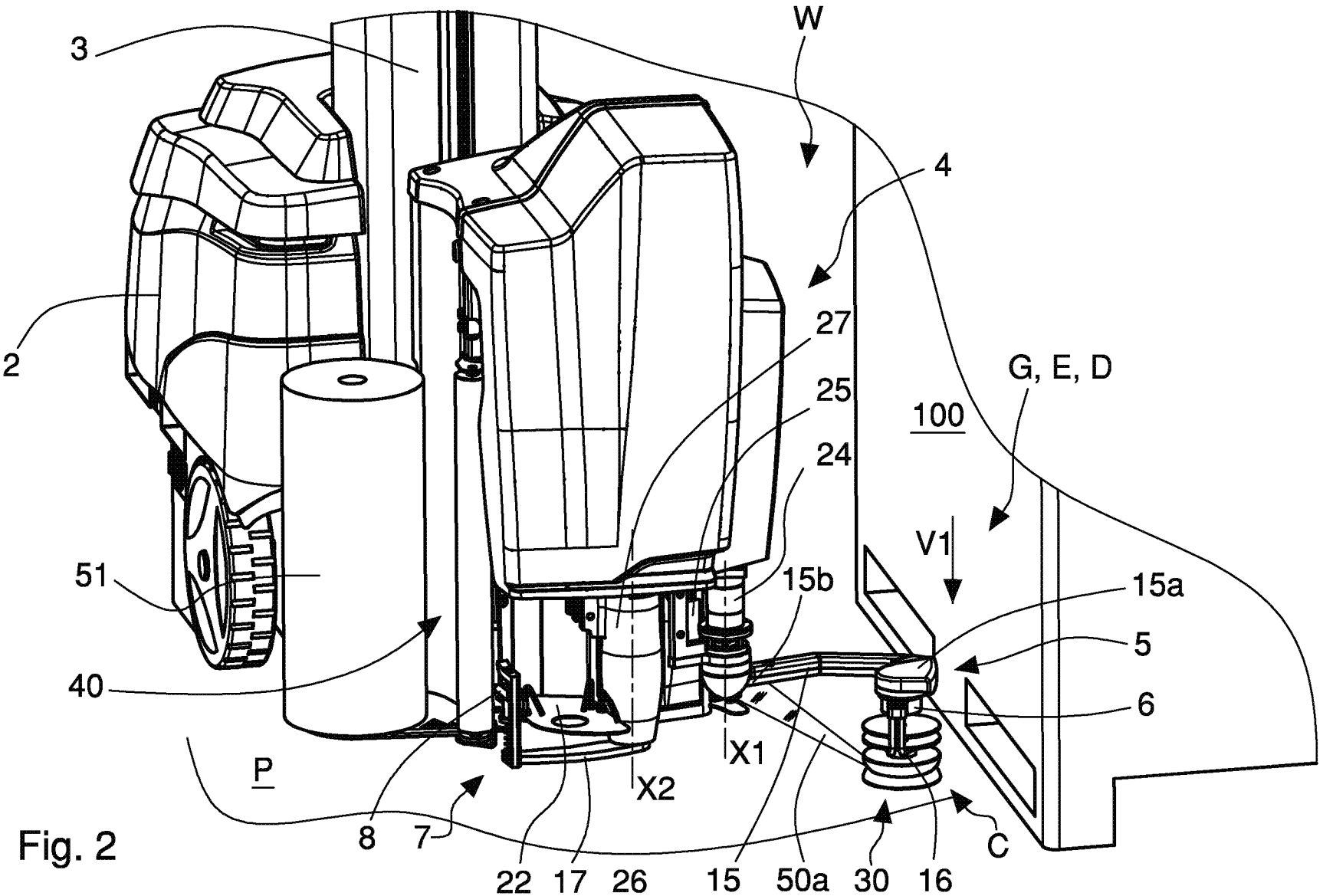
FIG. 2 is an enlarged partial perspective view of the self-propelled wrapping machine of FIG. 1 in a positioning step of an anchoring element to which an initial flap of film is associated.
Figure 5:
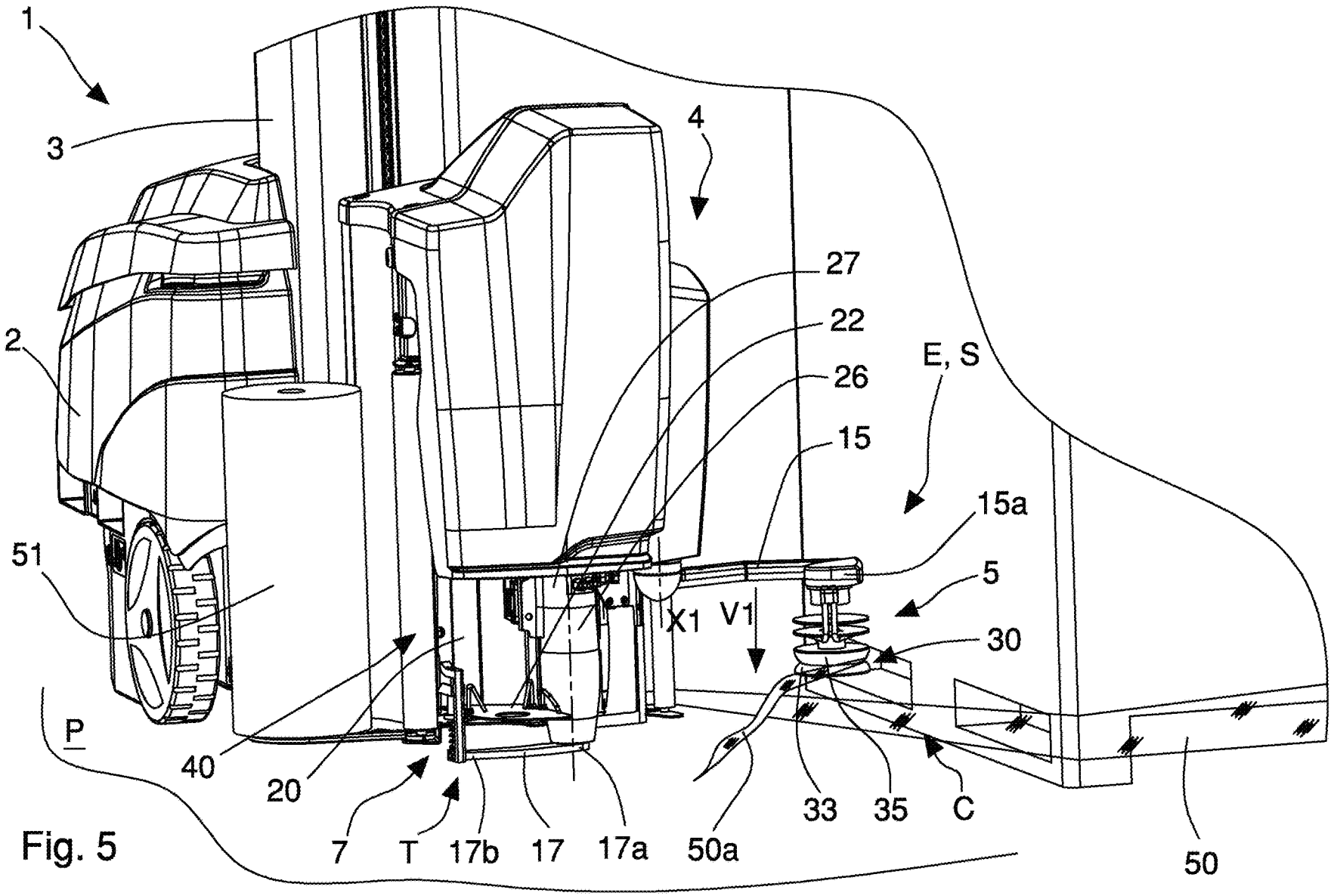
FIG. 5 is an enlarged partial perspective view of the wrapping machine of FIG. 1 in a step of gripping and raising the anchoring element to which an initial flap of film is still associated.
Figure 6:
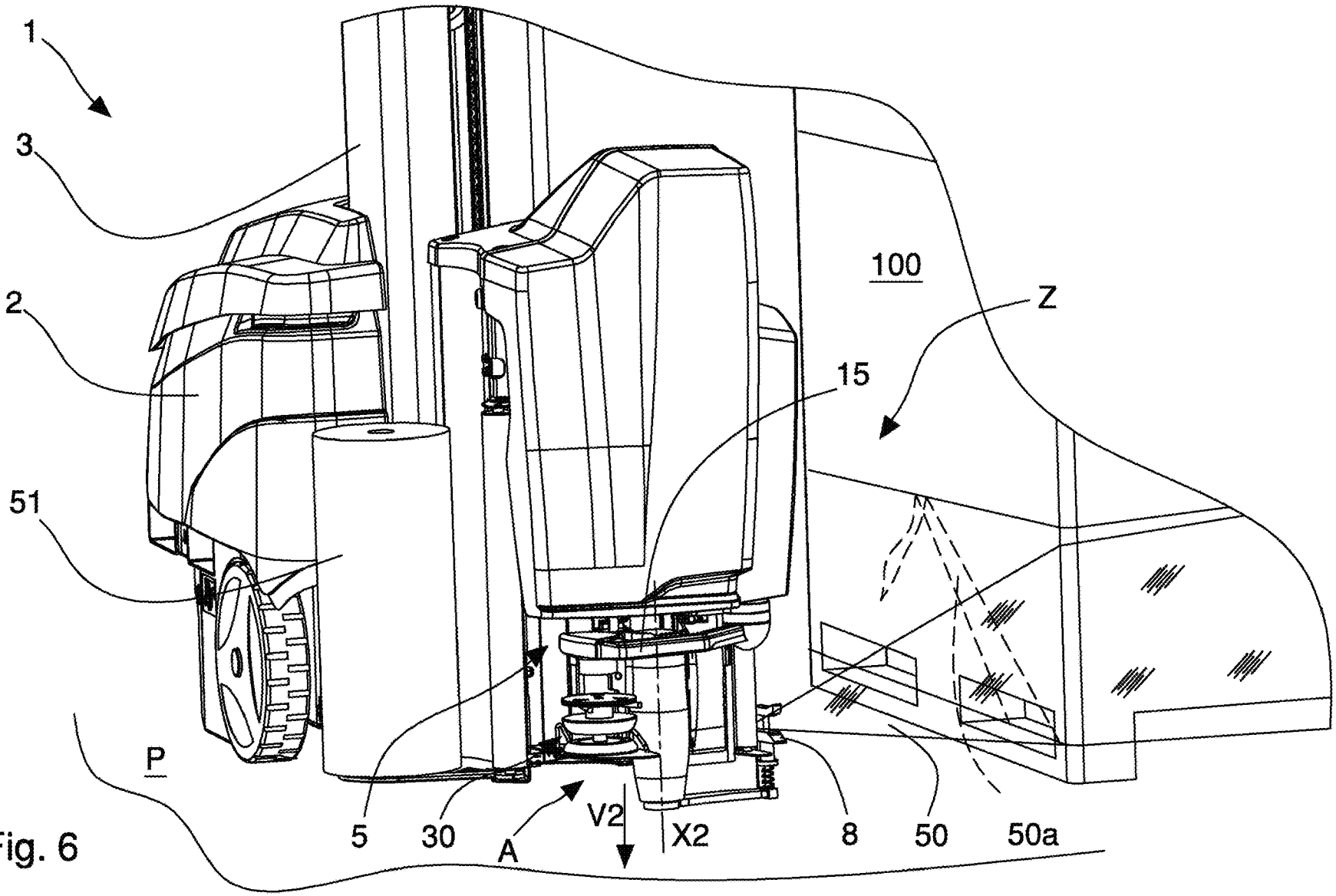
FIG. 6 is an enlarged partial perspective view of the machine of FIG. 1 in a step of gripping a portion of film at the end of wrapping the load.
Figure 8:
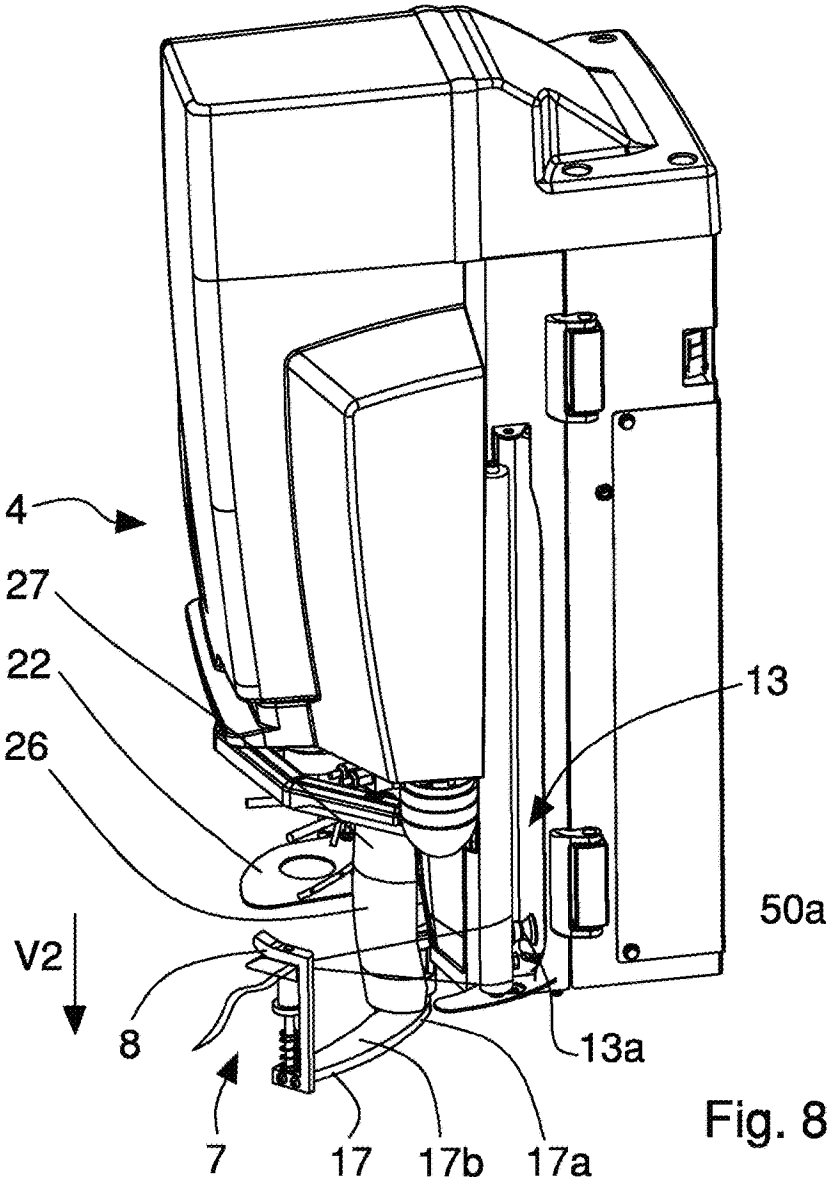
FIGS. 7 and 8 are enlarged partial perspective views, from different angles, of the machine of FIG. 1 illustrating in particular a second gripping unit respectively in the step of gripping and transferring an initial flap of film.
Figure 7:
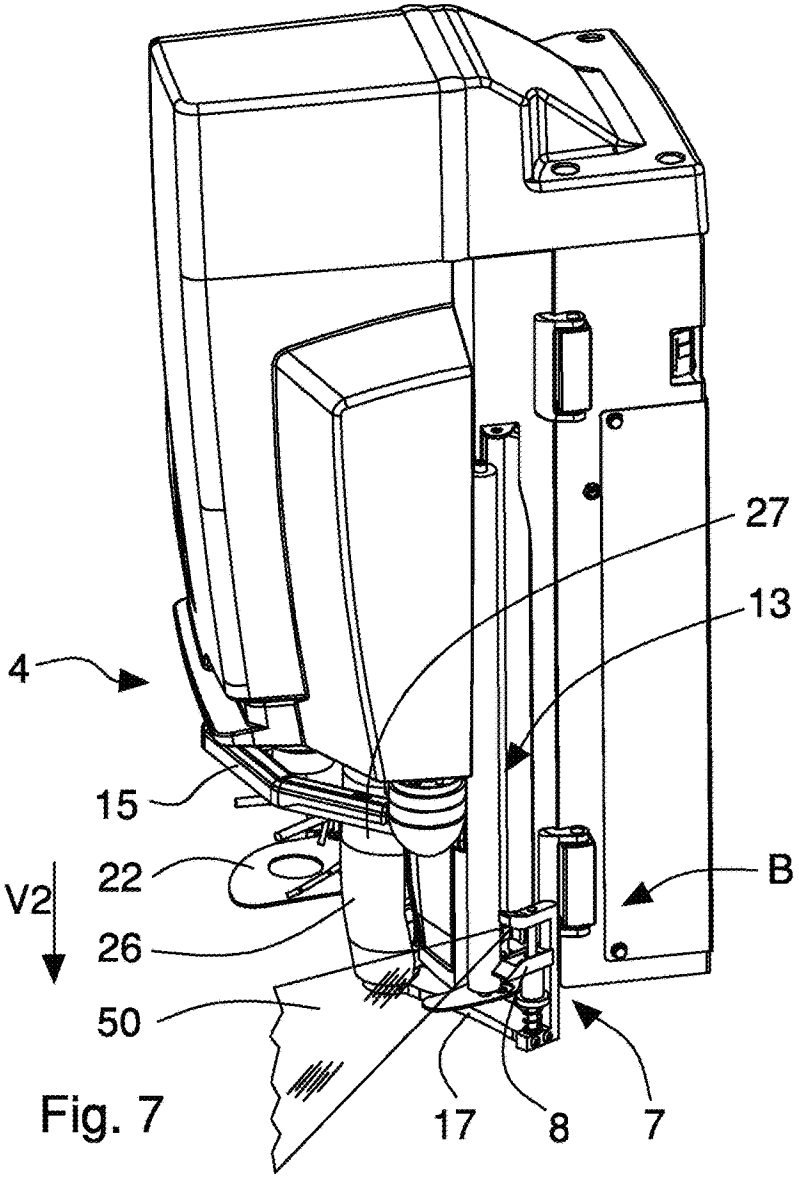
Figure 9:
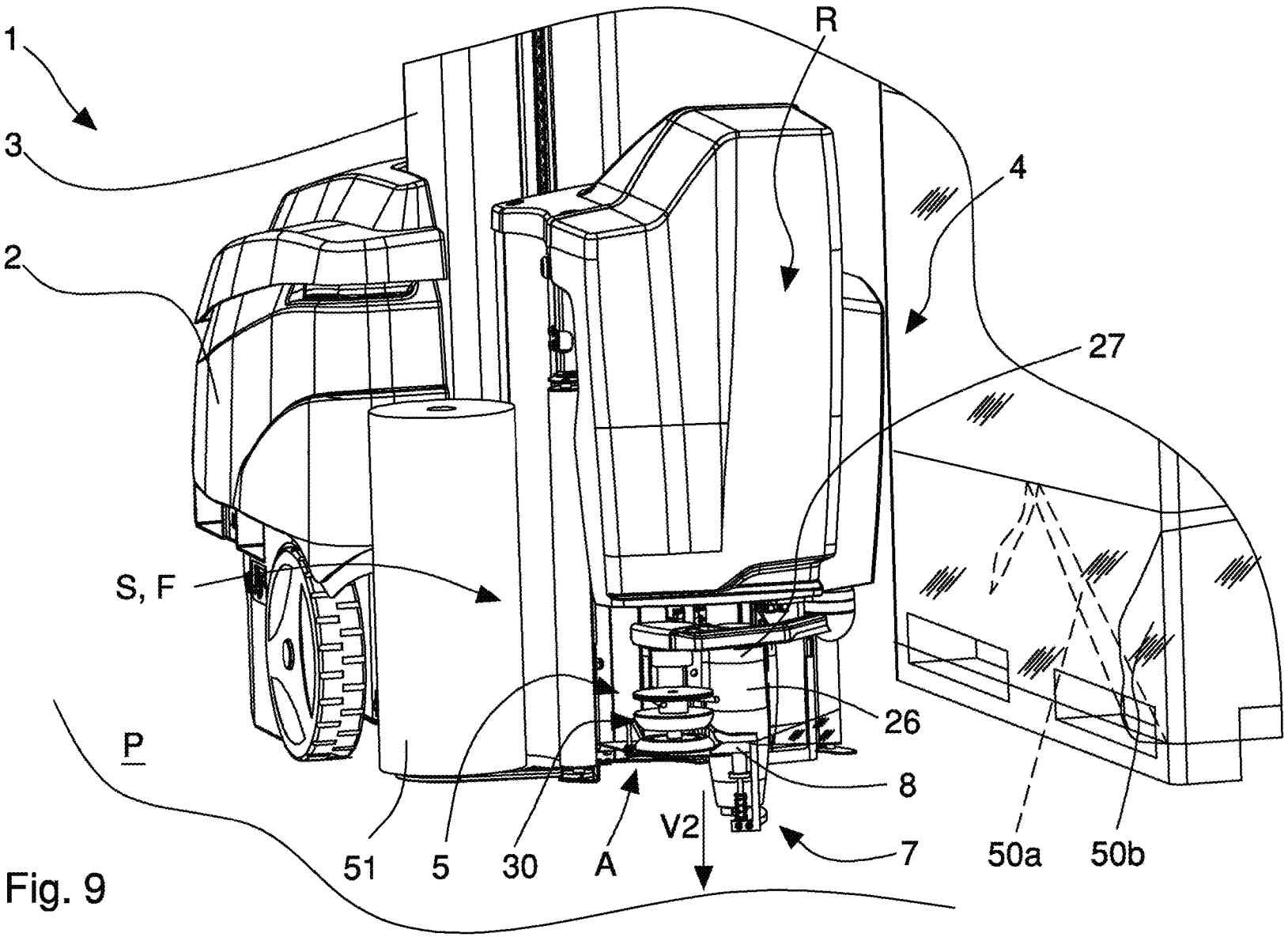
FIG. 9 is an enlarged partial perspective view of the machine of FIG. 1 in a step of transferring the initial flap of film to the anchoring element arranged in a housing of the wrapping machine.

With particular reference to FIGS. 2 and 6, the first gripping unit 5 is movable at least between a retracted configuration R, in which the first gripping means 6, 16 are adjacent to the carriage 2, in particular to position/pick up the anchoring element 30 in/from the housing 22 of the carriage 2, and a gripping/releasing configuration G, in which the gripping means 6, 16 are spaced from the carriage 2 and adjacent to the supporting plane P, in particular for grasping or releasing the anchoring element 30 on the supporting plane P.

The first gripping unit 5 comprises a first arm 15 provided with a coupling end 15*b*, which is rotatably and slidably connected to the carriage 2, and a supporting end 15*a*, which supports the first and the second gripping means 6, 16.

The electromagnet means 6 are fixed to a lower face of the supporting end 15*a* of the first arm 15. The fork element 16 comprises a pair of prongs 16*a* arranged in a "V" shape on a plane substantially parallel to the supporting plane P and connected to a supporting stem 16*b*, substantially vertical to the supporting plane P, fixed to the lateral face of the supporting end 15*a* of the first arm 15.

The first arm 15 is movable in rotation about a first rotation axis X1, in particular substantially orthogonal to the supporting plane P, between a retracted angular position F, in which the supporting end 15*a* is more adjacent to the carriage 2 and an extended angular position E in which the supporting end 15*a* is more spaced apart from the carriage 2. The first arm 15 is also movable linearly along a first movement direction V1, in particular substantially orthogonal to the supporting plane P, at least between a raised linear position S, in which the supporting end 15*a* is farther away from the supporting plane P, and a first and a second lowered linear position D1, D2 in which the supporting end 15*a* is closer to the supporting plane P.

More precisely, in the retracted configuration R of the first gripping unit 5, the first arm 15 is arranged in the retracted angular position F and in the first lowered linear position D1 so as to allow the gripping means 6, 16 to position the anchoring element 30 in the housing 22. In the gripping/releasing configuration G of the first gripping unit 5, the first arm 15 is positioned in the extended angular position E and in the second lowered linear position D2 so as to allow the gripping means 6, 16 to release or pick up the anchoring element 30 on/from the supporting plane P.

First driving means 24 are provided for rotating the first arm 15 about the first rotation axis X1 between the retracted angular position F and the extended angular position E, and second driving means 25 for moving the first arm 15 along the first movement direction V1 between the raised linear position S and the lowered linear positions D1, D2.

The self-propelled wrapping machine 1 further comprises a second gripping unit 7 supported by the carriage 2, movable and configured to grip a portion of the film 50 comprised between the load 100 and the unwinding unit 4, in a final step of the wrapping cycle, pull said portion of the film 50 until it is sheared, in particular by tearing it completely, and dragging and transferring an initial flap 50*a* of film thus obtained to the anchoring element 30 positioned in the housing 22 of the carriage 2 to be locked between the locking element 35 and the base 33, as better explained in the following description.

The second gripping unit 7 comprises third gripping means 8 adapted to grip and retain the film 50 and is movable between a gripping position B, in which the aforesaid third gripping means 8 are spaced from the carriage 2 for intercepting and gripping a portion of the film 50 comprised between the load 100 and the unwinding unit 4, and a transfer position T, in which the aforesaid second gripping means 8 are adjacent to the carriage 2 and the anchoring element 30 arranged in the housing 22, for transferring the initial flap 50*a* of film to the anchoring element 30.

The second gripping means 8 comprise, for example, a gripper with suitably chamfered tips associated with a spring locking mechanism 81 of the film which is mechanically operated, in particular by the film 50 itself in the closed position and by an abutment fixed to the supporting frame 20 of the carriage 2 in the open position.

The second gripping unit 7 comprises a second arm 17 having a first end 17*a* rotatably connected to the carriage 2 and a second end 17*b* supporting the third gripping means 8. Third driving means 26 are provided to rotate the second arm 17 around a second rotation axis X2 between the gripping position B and the transfer position T.

In the embodiment shown in the figures, the second arm 17 is also slidably connected at the first end 17*a* to the carriage 2 so as to be movable along a second movement direction V2, in particular substantially orthogonal to the supporting plane P. To this end, the self-propelled wrapping machine 1 comprises fourth driving means 27 adapted to linearly move the second arm 17 along the second movement direction V2.

The unwinding unit 4 comprises frame means adapted to support the reel 51 and roller means 20 which are arranged to unwind the film 50 from the reel 51, pre-stretch it and divert it towards the load 100.

The roller means comprise, for example, a pair of pre-stretching rollers and one or more guide rollers for stretching or lengthening the film 50 during the unwinding from the reel 51 and before wrapping on the load 100.

The unwinding unit 4 further comprises folding means 13 of known type and not described in further detail, adapted to collect and transversely narrow the film 50 exiting from the roller means 40, so as to reduce a band width thereof or make a folded portion and form a cord or strip of film. The film 50 folded or rolled to form a cord or strip can be grasped more firmly by the second gripping means 8.

In particular, the folding means 13 comprise a linearly movable folding element 13*a* so as to abut transversely, in particular substantially orthogonally, one longitudinal edge of the film and push it, folding it and/or rolling it towards the opposite longitudinal edge. The folding means 13 further comprise a perforating element of known type and not illustrated in the figures, associated with the folding element 13*a* and intended to partially tear the film when said folding element 13*a* is moved, to facilitate the complete tearing of the film by the second gripping unit 7 at the end of the wrapping cycle.

The carriage 2 comprises two or more traction wheels, a directional wheel and guide means for guiding the self-propelled wrapping machine 1 along a wrapping path around the load 100. For example, the self-propelled wrapping machine 1 is provided with a pair of rear traction wheels, at least one of which driven by the motor means, and a front directional wheel.

In the embodiment the self-propelled wrapping machine 1 comprises sensors capable of detecting external surfaces and corners of the load 100 and processing related signals, and a control unit adapted to receive the aforementioned signals from the sensors, calculating a wrapping path such as to avoid collisions with the load 100 and controlling the guide means so as to guide the self-propelled wrapping machine 1 along the wrapping path. The guide means 10 comprise in particular driving means controlled by the control unit and arranged to steer the directional wheel or driving means also controlled by the control unit and arranged to vary the speed of the traction wheels.

Alternatively, the guide means 10 comprise a feeler arm, of known type, arranged to follow an external profile of the load 100 during the wrapping step and connected to the directional wheel to steer the latter and move the carriage 2 along the wrapping path.

The control unit of the self-propelled wrapping machine 1 is also arranged to command and control in a coordinated way the movement of the carriage 2 around the load 100, the dispensing of the film 50 from the unwinding unit 4, the movement thereof along the upright 3, the actuation of the gripping units 5, 7 in the different steps of the wrapping cycle.

The self-propelled wrapping machine 1 is also provided with sensor means, of the known type, for example comprising photocells or capacitive sensors, or the like, capable of detecting the overall dimensions and sizes of the load 100 and the distances between the latter and the self-propelled wrapping machine 1 during operation. The signals of the sensor means are sent to the control unit of the machine to allow the proper execution of the different steps of the wrapping cycle.

In operation, the self-propelled wrapping machine 1 of the invention performs wrapping cycle of the load 100 according to the following steps.

In a first initial step the self-propelled wrapping machine 1 is positioned adjacent to the load 100, and thus activated so as to move around the load 100 for at least one turn in order to calculate and identify a defined initial position W at the beginning of the wrapping cycle, for example at a side along the load 100 having a rectangular plan shape. More precisely, thanks to the sensor means which detect the overall dimensions and sizes of the load 100, the control unit is able to stop the self-propelled wrapping machine in the defined initial position W. The first gripping unit 5 is arranged in the retracted configuration R, in which the gripping means 6, 16 are capable of engaging and interacting with the anchoring element 30 positioned in the housing 22 of the supporting frame 20 of the carriage 2. More precisely, in such a retracted configuration R of the first gripping unit 5, the first arm 15 is arranged in the retracted angular position R and in the first lowered linear position D1 so that the first gripping means 6 abut the upper plate 32 and the second gripping means 16 do not abut the intermediate plate 36. In such a configuration, the initial flap 50*a* of film unwound from the reel 51, for example obtained by cutting the film 50 at the end of a previous wrapping cycle, is locked between the locking element 35 and the base 33 of the anchoring element 30 arranged abutted in the closed configuration C. As explained above, when the anchoring element 30 is released and disengaged from the first or second gripping means 6, 16 or when it is gripped and lifted by the first gripping means 6 acting on the upper plate 32, the locking element 35 is brought and/or kept abutting the base 33 by the force of gravity acting thereon so as to lock and retain the initial flap 50*a* of film.

In a second step, the electromagnetic means of the first gripping means 6 are operated so as to interact with the upper plate 32 and grasp the anchoring element 30 and the first gripping unit 5 is moved from the retracted configuration R to the gripping/releasing configuration G, in which the supporting end 15*a* of the first arm 15 is adjacent to the load 100 and to the supporting plane P to release on the latter the anchoring element 30 to which the initial flap 50*a* of film is fastened.

More in detail, the electromagnet means of the first gripping means 6 are activated so as to grasp and lock the upper plate 32 of the anchoring element 30 and the first arm 15 is moved by the second driving means 25 along the first movement direction V1 from the first lowered linear position D1 to the raised linear position S so as to lift the anchoring element 30 from the housing 22.

The first arm 15 is then moved by the first driving means 24 between the retracted angular position F and the extended angular position E and then again moved by the second driving means 25 along the first movement direction V1 from the raised linear position S to the second lowered linear position D2 to deposit the anchoring element 30 on the supporting plane P.

In a third step, the anchoring element 30 retaining the initial flap 50*a* of film is released from the first gripping unit 5. More precisely, the electromagnet means of the first gripping means 6 are deactivated to allow their disengagement from the upper plate 32 and the first arm 15 is rotated away to also disengage the second gripping means 16 from the anchoring element 30 and thus lifted.

The first gripping unit 5 disengaged from the anchoring element 30 is brought from the gripping/release configuration G to the retracted configuration R.

In a fourth step, the self-propelled wrapping machine 1 is moved around the load 100 for at least one turn so as to wrap the latter with the film 50 dispensed from the unwinding unit 4. The film 50, whose initial flap 50*a* is fixed to the anchoring element 30, is thus wrapped, and adheres and fastens firmly to the load 100. The film 50 is dispensed from the unwinding unit 4 at full height, i.e., not rolled or narrowed transversely.

In a fifth step, the self-propelled wrapping machine 1 is stopped in the defined initial position W.

Preferably before the stop of the self-propelled wrapping machine, the folding means 13 are operated to narrow and/or roll the film so as to form a stretch of reduced height at the anchoring element 30.

The first gripping unit 5 is then moved from the retracted configuration R to the gripping/release configuration G to grip and lift the anchoring element 30 from the supporting plane P. More precisely, in the extended angular position E and in the second lowered linear position D2 of the first arm 15 the electromagnet means of the first gripping means 6 are activated so as to engage and lock the upper plate 32. Thereby, the locking element 35 and the base 33 remain abutted in the closed configuration C continuing to lock the initial flap 50*a* of film.

The first gripping unit 5 then lifts the anchoring element 30 from the supporting plane P, which still locks and retains the initial flap 50*a* of film. More precisely, the first arm 15 is moved by the second driving means 25 along the first movement direction V1 from the second lowered linear position D2 to the raised linear position S, in particular to a greater height of the restricted/rolled stretch of film comprised between the unwinding unit 4 and the load 100.

In a sixth step the first gripping unit 5 is moved in rotation towards the carriage 2 by a defined stretch so that the anchoring element 30 passes the portion of the film comprised between the load 100 and the unwinding unit 4 and the initial flap 50*a* of film can be released and can fall back on the portion of the film. More precisely, the first arm 15 is rotated by the first driving means 24 from the extended angular position E towards the retracted angular position R by a defined stretch and then stopped.

The electromagnet means of the first gripping means 6 are deactivated and the anchoring element 30 released by the latter is engaged and supported by the second gripping means 16. More precisely, the fork element 16 underlying the electromagnet means of the first gripping means 6 receives and engages the intermediate plate 38 when the anchoring element 30 detaches from the first gripping means 6. Thereby, as shown in FIG. 14, while the anchoring element 35 is supported by the fork element 16, the base 33 with the upper plate 32 is free to slide downwards by virtue of the force of gravity and detach from the locking plate 36 in the open configuration A.

The initial flap 50*a* of film thus released and disengaged from the anchoring element 30 can fall back, depositing on the underlying portion of the film comprised between the load 100 and the unwinding unit 4.

It is also possible, before moving the first gripping unit 5 in rotation by a defined stretch towards the carriage 2, to move the self-propelled wrapping machine 1 around the load 100 by a respective defined stretch to increase the length of the restricted portion of film between the load 100 and the unwinding unit 4 and lift the latter, moving it along the upright 3 to decrease a distance between the first gripping unit 5 and the underlying portion of film to ensure that the initial flap 50*a* of film falls thereon once released.

In a seventh step, the first gripping unit 5 transfers and positions the anchoring element 30 in the housing 22 of the supporting frame 20 of the carriage 2. For this purpose, the first arm 15 is rotated by the first driving means 24 in the retracted position F and is then moved along the first movement direction V1 by the second driving means 25 from the raised position S to the first lowered position D1 to deposit the anchoring element 30 in the housing 22. In such a first lowered position D1 the anchoring element 30 is positioned in the housing 22 disengaged from the first and the second gripping means 6, 16 and thus with the locking plate 36 and the base 33 abutting in the closed configuration C.

In an eighth step, the self-propelled wrapping machine 1 is activated again to move around the load 100 for a defined number of turns so as to wrap the latter with the film 50 according to a defined wrapping configuration.

The initial flap 50*a* of film that was arranged transversely above the portion of the film comprised between the load 100 and the unwinding unit 4, substantially "straddling" such portion is thus fixed to the nearest wall of the load 100, in particular wrapped and covered by one or more bands of film 50 superimposed thereon. Thereby, advantageously the initial flap 50*a* of film completely adheres to the load, covered by other bands of film, and does not remain exposed and lying on the supporting plane P.

The wrapping step envisages, during the rotation of the carriage 2 around the load 100, moving the unwinding unit 4 with alternate motion along the upright 3 and the simultaneous dispensing of the film 50, possibly pre-stretched or lengthened from the unwinding unit 4. During the wrapping of the load 100, in particular when the unwinding unit 4 is lifted and farther from the supporting plane P, the second gripping unit 7 is moved by the third driving means 26 from the transfer position T to the gripping position B.

In a ninth step, at the end of the wrapping, the self-propelled wrapping machine 1 is stopped in a defined final position Z, possibly coincident with the initial position W, and the second gripping unit 7 is operated to grasp a portion of the film 50 comprised between the unwinding unit 4 and the load 100, stretch it and then shear it so as to make a new initial flap 50*a* of film retained by the same second gripping unit 7 and a final flap or end 50*b* of film associated with the load 100.

Before moving the second gripping unit 7, the folding means 13 of the unwinding unit 4 are operated to roll and/or transversely narrow the film 50 and at the same time partially tear it. For this purpose, during the descent of the folding element 13*a*, which engages and pushes for example an upper longitudinal edge of the film 50 towards the lower longitudinal edge, the perforating element is activated to intercept and tear the film. The film 50 is transversely narrowed in width and partially torn so as to be grasped and held more firmly by the second gripping means 8 of the second gripping unit 7 and more easily completely torn from the latter.

At the same time, the first arm 15 of the first gripping unit 5, arranged in the retracted angular position F and in the first lowered linear position D1, is moved along the first movement direction V1 by a defined section upwards so that the second gripping means 16 are capable of abutting and then lifting the intermediate plate 38 of the locking element 30 and the locking plate 36 therewith. The latter is then separated and spaced from the base 33 in the open configuration A to allow the subsequent insertion of the initial flap 50*a* of film between the aforesaid locking plate 36 and the base 33.

In particular in this ninth step, the second arm 17 of the second gripping unit 7 is rotated by the third driving means 26 from the gripping position B, adjacent to the carriage 2, to the transfer position T to allow the third gripping means 8 to intercept, grasp and retain the portion of film 50 comprised between the unwinding unit 4 and the load 100 and then pull it until it is completely torn so as to make a new initial flap 50*a*, to be associated with the locking element 30, and a final flap 50*b* associated with the load 100 (FIGS. 10 and 11). The tipped gripper of the third gripping means 8 is driven in closing so as to lock the film 50 by the locking mechanism 81 mechanically driven by the same film 50.

The third gripping means 8 retains the new initial flap 50*a* of film which is then inserted between the locking plate 36 and the base 33 (arranged spaced apart from each other in the open configuration A) of the anchoring element 30 placed in the housing 22, when the second gripping unit 8 is arranged in the transfer position T in a tenth step.

When the second gripping unit 4 has reached the transfer position T, the locking mechanism 81 of the third gripping means 8 is driven in the opening position, so as to release the film 50, thanks to the contact with an abutment provided on the supporting frame 20. At the same time, the first gripping arm 5 is moved downwards along the first movement direction V1 so as to lower and then disengage the second gripping means 16 from the intermediate plate 38 and arrange the locking plate 36 and the base 33 abutting in the closed configuration C to retain and lock the initial flap 50*a* of film.

The second gripping unit 7 disengaged from the initial flap 50*a* of film remains in the transfer position T.

The self-propelled wrapping machine 1 of the invention therefore allows to wrap a load 100 with a film 50 completely automatically, i.e., without requiring any manual intervention by the operator, both in an initial step of the wrapping cycle, in which an initial flap 50*a* of film must be retained during a first wrapping turn of the film 50 around the load 100, and in a final step, in which the film 50 must be cut and the initial flap of film generated by the cut must be retained.

The anchoring element 30, which is positioned and released by the first gripping unit 5 on the supporting plane P adjacent to the load 100, thanks to the locking element 35 and its weight, allows the initial flap 50*a* of film to be firmly and safely retained in an initial step of the wrapping cycle of the load 100 in which said initial flap 50*a* of film is fastened to the load 100 by the same film 50 wound on the latter.

The anchoring element 30 is then recovered from the first gripping unit 5 after the film 50 has been suitably wrapped and fastened to the load 100 with at least one wrapping turn, so as not to hinder the subsequent wrapping step. These operations are performed completely automatically, managed by the control unit of the self-propelled wrapping machine 1.

It should be noted that the particular retrieval procedure of the anchoring element 30 allows to release the initial flap 50*a* of film on the portion of the film comprised between the load 100 and the unwinding unit so that the initial flap 50*a* of film does not remain protruding outside the load 100 but is wrapped and covered by successive bands of film around the load. Also the operation which involves gripping and shearing the film 50 to obtain the two initial and final flaps 50*a*, 50*b* is performed at the end of the wrapping cycle completely automatically by the self-propelled wrapping machine 1.

The method according to the invention for wrapping a load 100 by means of the self-propelled wrapping machine 1 described and illustrated in FIGS. 1 to 10 comprises a wrapping cycle including the following operating steps:

positioning the self-propelled wrapping machine 1 mobile on the supporting plane P adjacent to the load 100 in a defined initial position W (step 1);

by means of the first gripping unit 5, picking up from the housing 22 of the carriage 2 of the self-propelled wrapping machine 1 and then moving the anchoring element 30 which retains an initial flap 50*a* of film unwound from the reel 51 of the unwinding unit 4 and positioning the anchoring element 30 on the supporting plane P near the load 100 (step 2);

releasing on the supporting plane P the anchoring element 30 retaining the initial flap 50*a* of film, disengaging the first gripping unit 5 (step 3);

moving the self-propelled wrapping machine 1 around the load 100 for at least one turn, wrapping the latter with the film 50 dispensed from the unwinding unit 4 (step 4);

stopping the self-propelled wrapping machine 1 in the defined initial position W and by means of the first gripping unit 5 grasping and lifting the anchoring element 30, which holds the initial flap 50*a* of film, above a portion of the film 50 comprised between the load 100 and the unwinding unit 4 (step 5);

by means of the first gripping unit 5, moving the anchoring element 30 towards the housing 22 in the carriage 2 and disengaging the initial flap 50*a* of film from the anchoring element 30 so that it falls on the portion of the film comprised between the load 100 and the unwinding unit 4 (step 6);

by means of the first gripping unit 5 positioning the anchoring element 30 inside the housing 22 (step 7);

moving the self-propelled wrapping machine 1 around the load 100 for a defined number of turns and wrapping the latter with the film 50, with the initial flap 50*a* of film which is fastened to a wall of the load 100 wrapped and covered by at least one band of film 50 superimposed thereon (step 8);

stopping the self-propelled wrapping machine 1 in a defined final position Z, and grasping with the second gripping unit 7 a portion of the film 50 comprised between the unwinding unit 4 and the load 100 and moving the second gripping unit 7 to make a new initial flap 50*a* of film retained by the second gripping unit 7 and a final flap 50*b* of film associated with the load 100 (step 9);

by means of the second gripping unit 7, transferring and associating the new initial flap 50*a* of film with the anchoring element 30 positioned in the housing 22 (step 10).

The method further comprises, after step 5 and before step 6, moving the self-propelled wrapping machine 1 around the load 100 for a respective defined section and moving the first gripping unit 5 towards the carriage 2 for a respective defined section so that the anchoring element 30 passes the portion of film comprised between the load 100 and the unwinding unit 4.

It is also envisaged to release and disengage the initial flap 50*a* of film from the anchoring element 30 when the anchoring element 30 has passed the film portion comprised between the load 100 and the unwinding unit 4, so that it falls above and "straddles" the aforesaid film portion.

In particular, the anchoring element 30 retains the initial flap 50*a* of film by means of the locking element 35 and the base 33 arranged in mutual abutment in the closed configuration C.

The first gripping unit 5 disengages the initial flap 50*a* of film from the anchoring element 30, arranging the locking element 35 and the base 33 mutually spaced in the open configuration A, in particular by second gripping means 16 of the first gripping unit 5.

The method further comprising before step 5 transversely narrowing the film 50 by means of the folding means 13 of the unwinding unit 4 so as to reduce a band width thereof.

According to the method it is provided after said stopping the self-propelled wrapping machine 1 in the defined final position Z and before said grasping with the second gripping unit 7, transversely narrowing the film 50 by means of the folding means 13 so as to reduce a band width thereof. It is further provided during said transversely narrowing, to partially tear the film 50.

The method comprising, before positioning the self-propelled wrapping machine 1 in the defined initial position W, moving the latter around the load 100 for at least one turn to calculate and identify the defined initial position W, in particular to identify a longer side of said load 100.

The invention claimed is:

1. A self-propelled wrapping machine movable on a supporting plane around a load to wrap the load with a film made of plastic material during a wrapping cycle, the self-propelled wrapping machine comprising:

a self-propelled carriage;

an upright fixed to said self-propelled carriage and slidably supporting an unwinding unit provided with at least one reel of film;

an anchoring element which includes a base, adapted to abut the supporting plane and connected by means of a central pin to an upper plate, and a locking element interposed between said upper plate and said base, engaged with, and movable along, said central pin, said locking element and said base with said upper plate being movable relative to each other between a closed configuration, in which said locking element and said base abut to each other, and an open configuration, in which said locking element and said base are spaced apart; and a first gripping unit supported by said self-propelled carriage, movable and configured to position and release said anchoring element, associated with an initial flap of film that is locked between said locking element and said base arranged in the closed configuration, on the supporting plane adjacent to the load in an initial step of the wrapping cycle, and to grasp and lift said anchoring element and move said locking element and said base with respect to each other in the open configuration so as to release the initial flap of film after at least one turn travelled by the self-propelled wrapping machine around the load while wrapping the load with the film delivered by said unwinding unit, wherein said first gripping unit comprises a first gripping assembly and a second gripping assembly selectively and alternatively activable to engage and grasp respectively said upper plate or said locking element, said first gripping assembly also being configured to arrange and, additionally or alternatively, maintain said locking element and said base in the closed configuration, and said second gripping assembly also being configured to arrange and, additionally or alternatively, maintain said locking element and said base in the open configuration.

2. The self-propelled wrapping machine according to claim 1, wherein said locking element is brought and, additionally or alternatively, held against said base by the force of gravity when said anchoring element is released by and disengaged from said first or second gripping assembly or when said anchoring element is gripped by said first gripping assembly acting on said upper plate.

3. The self-propelled wrapping machine according to claim 1, wherein said locking element includes a locking plate, adapted to abut said base and connected through a central element to an intermediate plate, said locking plate, said central element and said intermediate plate being aligned longitudinally by openings suitable for receiving and slidably engaging with said central pin.

4. The self-propelled wrapping machine according to claim 3, wherein said second gripping assembly comprises a fork element able to engage said locking element, said fork element being insertable between said intermediate plate and said locking plate so as to engage said central element, and said fork element abutting a lower face of said intermediate plate to lift and support said anchoring element.

5. The self-propelled wrapping machine according to claim 1, wherein said first gripping assembly comprises an electromagnet device which can be selectively activated or deactivated respectively to grasp or release said upper plate of said anchoring element.

6. The self-propelled wrapping machine according to claim 1, wherein said second gripping assembly comprises a fork element able to engage said locking element.

7. The self-propelled wrapping machine according to claim 1, wherein said first gripping unit is movable at least between a retracted configuration, in which said first and second gripping assemblies are adjacent to said self-propelled carriage, and a gripping/releasing configuration, in which said first and second gripping assemblies are spaced from said self-propelled carriage and adjacent to the supporting plane.

8. The self-propelled wrapping machine according to claim 7, wherein in the retracted configuration said first and second gripping assemblies are adjacent to said self-propelled carriage for positioning or picking up said anchoring element in/from a housing of said self-propelled carriage, and in the gripping/releasing configuration said first and second gripping assemblies are spaced from said self-propelled carriage and adjacent to the supporting plane to grasp or release said anchoring element on the supporting plane.

9. The self-propelled wrapping machine according to claim 1, wherein said first gripping unit further comprises a first arm provided with a coupling end rotatably and slidably connected to said self-propelled carriage and a supporting end supporting said first and second gripping assemblies, said first arm being rotatable about a first rotation axis between a retracted angular position and an extended angular position in which said supporting end is respectively more adjacent to, and more spaced from, said self-propelled carriage, and linearly along a first moving direction between a raised linear position and first and second lowered linear positions, in which said supporting end is respectively farther and closer to the supporting plane.

10. The self-propelled wrapping machine according to claim 9, further comprising a first driving system for rotating said first arm about the first rotation axis between the retracted angular position and the extended angular position, and a second driving system for linearly moving said first arm between the raised linear position and the first and second lowered linear positions.

11. The self-propelled wrapping machine according to claim 1, further comprising a second gripping unit supported by said self-propelled carriage, movable and configured to grip a portion of film that is located between the load and said unwinding unit in a final step of the wrapping cycle, in order to pull the portion of film until the portion of film is sheared and drag and transfer an initial flap of film thus obtained to said anchoring element that is positioned in a housing of said self-propelled carriage so as to be locked between said locking element and said base.

12. The self-propelled wrapping machine according to claim 11, wherein said second gripping unit comprises a third gripping assembly suitable for gripping and holding the film and is movable between a gripping position, in which said third gripping assembly is spaced apart from said self-propelled carriage in order to seize and grasp the portion of film that is located between the load and said unwinding unit and a transfer position, in which said third gripping assembly is adjacent to said self-propelled carriage and to said anchoring element arranged in said housing so as to transfer the initial flap of film to said anchoring element.

13. The self-propelled wrapping machine according to claim 12, wherein said second gripping unit further comprises a second arm, having a first end rotatably connected to said self-propelled carriage and a second end supporting said third gripping assembly.

14. The self-propelled wrapping machine according to claim 13, further comprising a third driving system for rotating said second arm about a second rotation axis between the gripping position and the transfer position.

15. The self-propelled wrapping machine according to claim 13, further comprising a fourth driving system, wherein said second arm is also slidably connected through said first end to said self-propelled carriage, and said fourth driving system is for linearly moving said second arm along a second moving direction.

16. The self-propelled wrapping machine according to claim 1, wherein said unwinding unit comprises rollers for stretching and unwinding the film and a folding assembly for collecting and at least one between narrowing transversely and partially tearing the film when exiting said rollers.

17. The self-propelled wrapping machine according to claim 1, wherein said first gripping unit is configured to grasp and retain in a final step of the wrapping cycle a narrowed and partially torn portion of film that is located between said unwinding unit and the load.

18. A method for wrapping a load by means of a self-propelled wrapping machine according to claim 1, the method comprising in a wrapping cycle the steps of:

positioning the self-propelled wrapping machine movable on the supporting plane adjacent to the load in a defined initial position (step 1);

by means of said first gripping unit picking from a housing of said self-propelled carriage of the self-propelled wrapping machine and then moving said anchoring element, which retains the initial flap of film unwound from the reel of said unwinding unit, and positioning said anchoring element on the supporting plane near the load (step 2);

releasing on the supporting plane said anchoring element, which holds the initial flap of film, by disengaging said first gripping unit (step 3);

moving the self-propelled wrapping machine around the load for at least one turn while wrapping the load with the film supplied by said unwinding unit (step 4);

stopping the self-propelled wrapping machine in the defined initial position and by means of said first gripping unit grasping and lifting said anchoring element, which holds the initial flap of film, above a portion of film that is located between the load and said unwinding unit (step 5);

by means of said first gripping unit moving said anchoring element towards said housing in said self-propelled carriage and disengaging the initial flap of film from said anchoring element so that the initial flap of film falls on the portion of film located between the load and said unwinding unit (step 6);

by means of said first gripping unit positioning said anchoring element inside said housing (step 7);

moving the self-propelled wrapping machine around the load for a defined number of turns and wrapping the load with the film, the initial flap of film being fixed to a wall of the load, wrapped and covered by at least one film band superimposed on the initial flap of film (step 8);

stopping the self-propelled wrapping machine in a defined final position and grasping with a second gripping unit a portion of film that is located between said unwinding unit and the load and moving said second gripping unit so as to shear the portion of film and make a new initial flap of film that is retained by said second gripping unit and a final flap of film that is associated with the load (step 9); and by means of said second gripping unit transferring and associating the new initial flap of film to said anchoring element positioned in said housing (step 10).

19. The method according to claim 18, further comprising after said step 5 and before said step 6, moving the self-propelled wrapping machine around the load for a respective defined space and moving said first gripping unit towards said self-propelled carriage for a respective defined space so that said anchoring element goes beyond the portion of film located between the load and said unwinding unit.

20. The method according to claim 18, wherein said anchoring element retains the initial flap of film by means of a locking element and a base arranged against to each other in a closed configuration.

21. The method according to claim 20, wherein said first gripping unit disengages the initial flap of film from said anchoring element by arranging said locking element and said base mutually spaced apart in an open configuration.

22. The method according to claim 18, further comprising before said step 5 by means of a folding assembly of said unwinding unit transversely narrowing the film so as to reduce a band width thereof.

23. The method according to claim 18, further comprising after said stopping of the self-propelled wrapping machine in the defined final position and before said grasping with said second gripping unit, by a folding assembly transversely narrowing the film so as to reduce a band width thereof.

24. The method according to claim 18, further comprising, before said positioning of the self-propelled wrapping machine in the defined initial position, moving the self-propelled wrapping machine around the load for at least one turn in order to calculate and identify the defined initial position.

* * * * *